US007273395B2

(12) United States Patent
Hayashi

(10) Patent No.: US 7,273,395 B2
(45) Date of Patent: Sep. 25, 2007

(54) WATERPROOF CONNECTOR AND SEAL MEMBER

(75) Inventor: Toshiaki Hayashi, Aichi (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/272,168

(22) Filed: Nov. 10, 2005

(65) Prior Publication Data

US 2006/0099842 A1 May 11, 2006

(30) Foreign Application Priority Data

Nov. 11, 2004 (JP) ..... 2004-328289

(51) Int. Cl.
*H01R 13/40* (2006.01)

(52) U.S. Cl. ..... 439/587

(58) Field of Classification Search ..... 439/587, 439/589, 275, 274

See application file for complete search history.

(56) References Cited

U.S. PATENT DOCUMENTS 4,715,827 A * 12/1987 Furman ..... 439/465
5,022,874 A * 6/1991 Lostumo ..... 439/724
6,132,249 A * 10/2000 Saito et al. ..... 439/587
6,383,022 B1 5/2002 Murakami et al.
6,739,908 B2 * 5/2004 Hamai et al. ..... 439/587

FOREIGN PATENT DOCUMENTS

| | | |
|---|---|---|
| JP | 07-142117 | 6/1995 |
| JP | 11-354195 | 12/1999 |
| JP | 2001-015204 | 1/2001 |

* cited by examiner

*Primary Examiner*—Phuong Dinh
(74) *Attorney, Agent, or Firm*—Barley Snyder LLC

(57) ABSTRACT

A waterproof connector comprises a housing with a plurality of contact receiving cavities. Each of the contact receiving cavities has a contact connected to an electric wire. A seal member has a plurality of adjacent wire receiving through-holes through which the electric wires extend. The seal member has cylindrical areas around a circumference of each of the wire receiving through-holes. The cylindrical areas partially overlap to form a continuous integral structure. The seal member is formed from an elastomer.

16 Claims, 3 Drawing Sheets

WATERPROOF CONNECTOR AND SEAL MEMBER

FIELD OF THE INVENTION

The invention relates generally to a waterproof connector and more particularly to a seal member for a waterproof connector.

BACKGROUND OF THE INVENTION

Electric connectors that prevent water from entering a housing of the electrical connector at water pressures under a specified level are commonly used in vehicles. These waterproof connectors have a seal member formed of an elastomer arranged at a wire receiving opening of the housing where electric wires are connected to a contact or a fitting component of a mating connector. The seal member seals the entrance for the electric wires, which are connected to contacts inside the housing to prevent the influx of water therein. The seal member may either be an individual seal member where the seal member is individually attached to each of a plurality of the electric wires or a collective seal member where the seal member is attached to the plurality of the electric wires as a group.

FIGS. 5(*a*)-5(*b*) show an example of a waterproof connector with individual seal members, as described in Japanese Patent Application Kokai H7-142117. As shown in FIG. 5(*a*), an electric wire 20, which has a contact 10 connected to a distal end thereof, is inserted through a wire receiving through-hole of a cylindrically shaped seal member 30. A crimp barrel 12 of the contact 10 is crimped onto a core of the electric wire 20, and an insulation support 13 of the contact 10 is pressed onto an insulation covering of the electric wire 20 and onto a distal end of the seal member 30. The electric wire 20 is held within a contact housing cavity 41 of the housing 40, as shown in FIG. 5(*b*). Flanges 34, which are formed around an outside circumference of the seal member 30, press against an inside wall of an opening to the housing 40 to the seal the housing 40.

In the seal member 30 of FIGS. 5(*a*)-5(*b*), each of the contact housing cavities 41 are individually sealed and thereby excellent waterproof performance is ensured. However, since it is necessary to attach and seal each of the electric wires 20 separately, it requires a large amount of time to assemble this type of waterproof connector.

FIGS. 6(*a*)-6(*b*) show an example of a waterproof connector with a collective seal member, as described in Japanese Patent Application Kokai 2001-15204. As shown in FIGS. 6(*a*)-6(*b*), a seal member 50 made from an elastomer is formed to have a plurality of wire receiving through-holes 52. An electric wire 20 connected to a contact 10 housed in a contact housing cavity 11 of a connector housing 70 is inserted through each of the wire receiving through-holes 52. A seal member cover 60 is positioned on the connector housing 70.

In the seal member 50 of FIGS. 6(*a*)-6(*b*), it is difficult to simultaneously insert the electric wires 20 into the wire receiving through-holes 52 of the seal member 50 during assembly of the waterproof connector. Therefore, each of the electric wires 20 is inserted successively. In order for an adequately tight seal to be formed between the seal member 50 and the electric wires 20, an inside diameter of the wire receiving through-holes 52 is made to be slightly smaller than an outside diameter of the electric wires 20. The seal member 50 therefore compresses around a circumference of the wire receiving through-holes 52 where the electric wire 20 has been inserted, which causes the adjacent wire receiving through-holes 52 to deform. Accordingly, as the number of inserted electric wires 20 increases, the more difficult the electric wire insertion process becomes. Additionally, the compression rate of the seal member 50 diminishes which compromises the seal member's sealing properties.

As shown in FIG. 6(*b*), in order to address this problem, a circumferential groove 53 is formed in the seal member 50 around the circumference of each of the electric wire receiving through-holes 52 and a cylindrically projecting partition wall 63 is formed around the circumference of each of the wire receiving through-holes 52 in the seal member cover 60. When the seal member cover 60 is assembled to the seal member 50, the partition walls 63 fit into the corresponding grooves 53. As a result, the wire receiving through-holes 52 are individually isolated, and it is possible to minimize the effects of the deformation of the seal member 50 on adjacent wire receiving through-holes 52.

FIGS. 7(*a*)-7(*b*) show an example of a waterproof connector with a collective seal member, as described in Japanese Patent Application Kokai H11-354195. As shown in FIG. 7(*a*), seal member 80 is divided into zones 81 that are disposed vertically and horizontally across the seal member 80. Each of the zones 81 in the illustrated embodiment has three wire receiving through-holes 82 for a total holding capacity of 27 electric wires. Each of the zones 81 is divided by a lattice shaped groove 83. This groove 83 receives a seal member cover 90 having substantially elliptical-shaped lattice apertures 91 formed to retain the zones 81, as shown in FIG. 7(*b*). With this structure, even when employing large seal members through which a large number of the electric wires pass, the seal member 80 can be viewed as having smaller, independent seal members, which allow the insertion of the electric wires without causing inadequate sealing due to diminished compression rate. The structure of the seal member 80, however, prevents the waterproof connector in which it is contained from being adequately miniaturized.

BRIEF SUMMARY OF THE INVENTION

It is therefore an object of the invention to provide a seal member for a waterproof connector wherein the waterproof connector can be kept small and can have excellent waterproof properties, and the seal member can prevent the deformation of adjacent wire receiving through-holes when electric wires are inserted in the seal member.

This and other objects are achieved by a waterproof connector comprising a housing with a plurality of contact receiving cavities. Each of the contact receiving cavities has a contact connected to an electric wire. A seal member has a plurality of adjacent wire receiving through-holes through which the electric wires extend. The seal member has cylindrical areas around a circumference of each of the wire receiving through-holes. The cylindrical areas partially overlap to form a continuous integral structure. The seal member is formed from an elastomer.

This and other objects are further achieved by a seal member comprising an elastomer with a plurality of adjacent wire receiving through-holes for receiving electric wires connected to contacts. Cylindrical areas around a circumference of each of the wire receiving through-holes. The cylindrical areas partially overlap to form a continuous integral structure.

BRIEF DESCRIPTION OF THE DRAWINGS

FIG. 1(*b*) is a rear perspective view of the waterproof connector;

FIG. 2(*b*) is a side view of the seal member;

FIG. 2(*c*) is a rear view of the seal member;

FIG. 4(*b*) is a sectional view of the waterproof connector of FIG. 1 taken along a direction parallel to a direction of insertion of electric wires therein;

FIG. 5(*b*) is a sectional view of the seal member of FIG. 5(*a*) positioned inside a housing;

FIG. 6(*b*) is an exploded view of a seal member and a seal member cover of the waterproof connector of FIG. 6(*a*);

FIG. 7(*b*) is a perspective view of a seal member cover according to the prior art.

DETAILED DESCRIPTION OF THE INVENTION

Figure 1A:
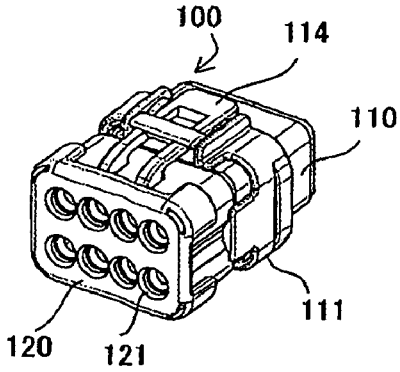
FIG. 1(*a*) is a front perspective view of a waterproof connector according to the invention.
Figure 1B:
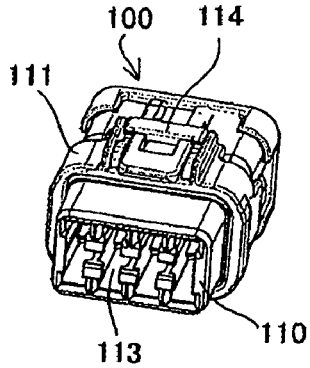
Figure 2A:
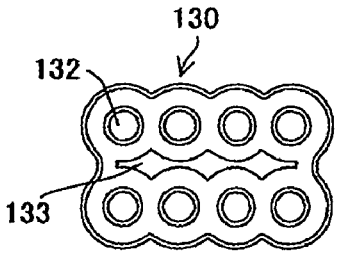
FIG. 2(*a*) is a front view of a seal member.
Figure 2B:
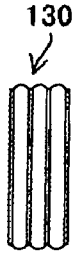
Figure 2C:
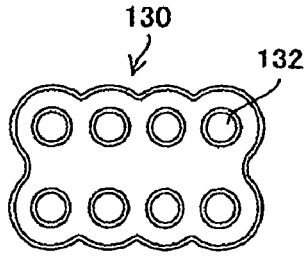
Figure 3:
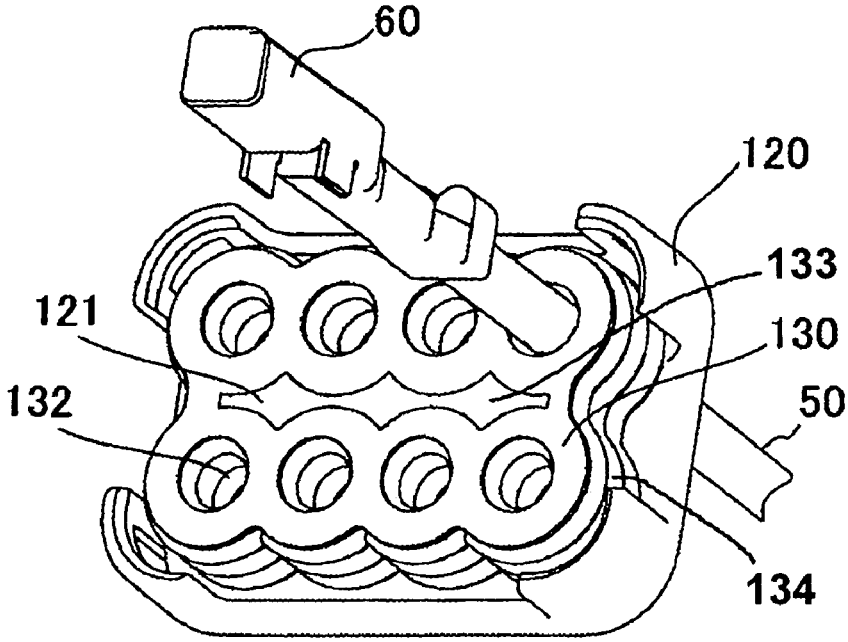
FIG. 3(*a*) is a perspective view of the seal member arranged in a seal member cover.
Figure 4A:
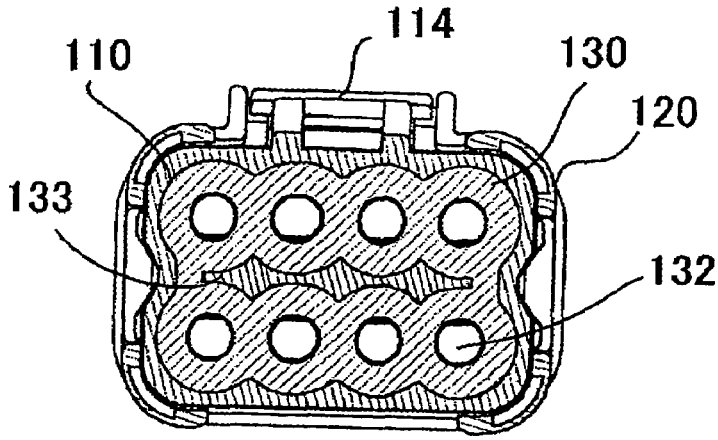
FIG. 4(*a*) is a sectional view of the waterproof connector of FIG. 1 taken along a direction perpendicular to a direction of insertion of electric wires therein.
Figure 4B:
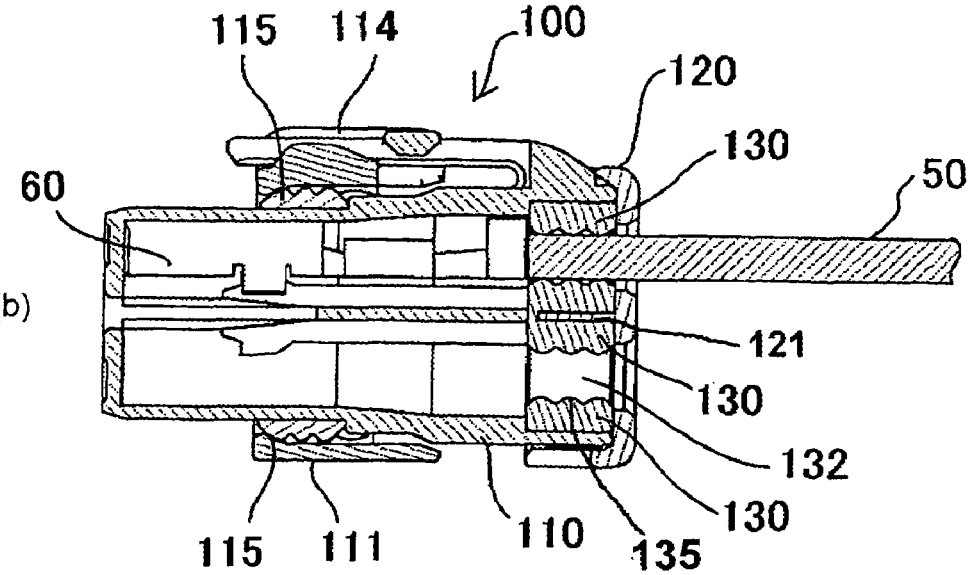
Figure 5A:
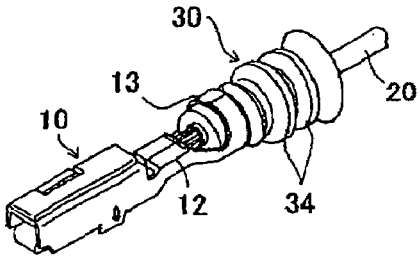
Figure 5(a) PRIOR ART
FIG. 5(*a*) is a perspective view of a seal member attached to an end of an electric wire according to the prior art.
Figure 5B:
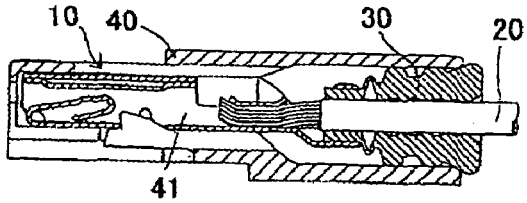
Figure 5(b) PRIOR ART
Figure 6A:
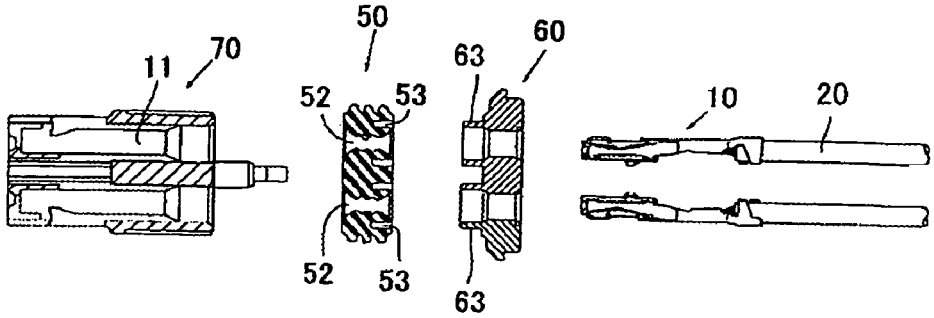
Figure 6(a) PRIOR ART
FIG. 6(*a*) is an exploded view of a waterproof connector according to the prior art.
Figure 6B:
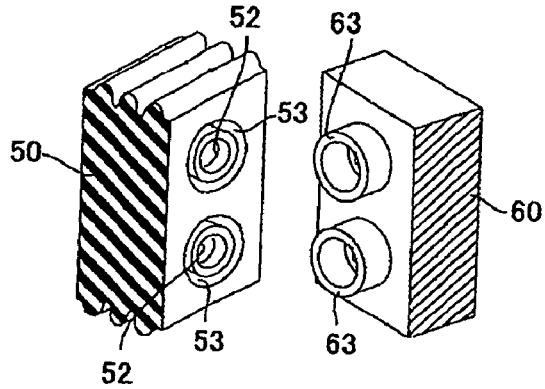
Figure 6(b) PRIOR ART
Figure 7A:
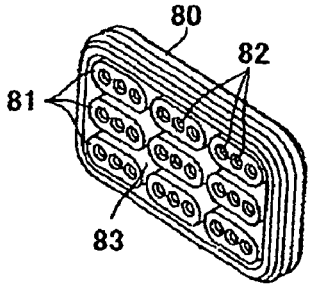
Figure 7(a) PRIOR ART
FIG. 7(*a*) is a perspective view of a seal member according to the prior art.
Figure 7B:
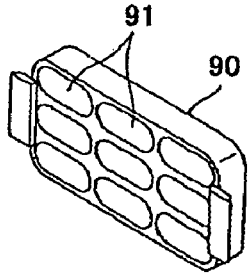
Figure 7(b) PRIOR ART

FIGS. 1(*a*)-4(*b*) show a waterproof connector 100 according to the invention. As shown in FIG. 1(*b*), the waterproof connector 100 comprises a housing 110 with contact receiving cavities 113. As shown in FIG. 3, contacts 60 are received in the contact receiving cavities 113. Electric wires 50 are attached to ends of the contacts 60. The electric wires 50 extend through a seal member 130 and a seal member cover 120 attached to a wire insertion side of the housing 110, as shown in FIGS. 2(*a*)-2(*c*). As shown in FIG. 4(*b*), a housing seal 115 is attached to an outside surface of the housing 100 adjacent to the contact receiving cavities 113. A protective cover 111 is positioned over the housing seal 115. A latch claw 114 is formed on the housing and engages a projection (not shown) on a mating connector housing (not shown) to fix the housing 110 thereto.

As shown in FIGS. 2(*a*)-2(*c*), the seal member 130 is constructed, for example, from an elastomer such as a silicone rubber. A plurality of wire receiving through-holes 132 extend through the seal member 130. The wire receiving through-holes 132 are arranged in zones that are each provided, for example, with an equal amount of the wire receiving through-holes 132. Although only two of the zones are shown in the illustrated embodiment, it will be appreciated by those skilled in the art that the seal member 130 may comprise any number of the zones. Additionally, although eight wire receiving through-holes 132 are shown as being formed in the seal member 130 in the illustrated embodiment, it will be appreciated by those skilled in the art that the seal member 130 may be provided with any number of the wire receiving through-holes 132. The wire receiving through-holes 132 in each of the zones are arranged in a substantially straight line and are arranged at a constant interval. A separating partition groove 133 is formed between the zones and separates the zones to prevent the zones from deforming each other.

In a cylindrical area around a circumference of each of the wire receiving through-holes 132, the material of the seal member 130 is formed to a specific thickness in a radial direction such that each of the electric wires 50 are received in its own individual cylindrical area or plug. The cylindrical areas are shaped in such a way that they overlap each other and may be regarded as being a continuous integral structure. By forming the seal member 130 in this manner, the seal at an entrance of the housing 110 between the housing 110 and the electric wires 50 is improved due to the seal member 130 exerting a uniformly tight compression in the radial direction around the entire circumference of each of the inserted electric wires 50.

As shown in FIG. 4(*b*), a plurality of wire engaging gussets 135 are formed on an inside surface of the wire receiving through-holes 132. The wire engaging gussets 135 have, for example, a peaked cross-section and are formed in a concentric fashion in a direction of thickness of the seal member 130. The wire engaging gussets 135 reduce the amount of friction between the electric wires 50 and the inside surface of the wire receiving through-holes 132 when the electric wires 50 are inserted therein to facilitate insertion and increase adhesion between the seal member 130 and the electric wires 50 to improve the seal there between. As shown in FIG. 3, a plurality of housing engaging gussets 134 is formed on an outside surface of the seal member 130 and extends about a circumference thereof. The housing engaging gussets 134 have, for example, a peaked cross-section with respect to the circumference of the seal member 130. The housing engaging gussets 134 improve the tightness of the seal between the seal member 130 and an inner wall of the housing 110 when the seal member 130 is inserted therein.

FIGS. 3 and 4(*b*) show a seal member cover 120 attached to the wire insertion side of the housing 110 to retain the seal member 130. A partition wall 121 protrudes from a substantial center of an inside of the seal member cover 120. The partition wall 121 fits in the partition groove 133 of the seal member 130. It is preferable to use the so-called two-color forming method to unitize the seal member 130 with the seal member cover 120, but the seal member cover 120 and the seal member 130 may also be formed separately and then assembled together. The seal member cover 120 is attached to the housing 110 by, for example, a latching claw (not shown).

As shown in FIG. 4(*b*), the shape of an inside surface of the seal member cover 120 matches the outside surface of the seal member 130. Openings are formed in the seal member cover 120 that correspond to the wire receiving through-holes 132 in the seal member 130. The openings are formed such that cylindrical areas of the seal member cover 120 are spaced at constant intervals and partially overlap and are continuous with the wire receiving through-holes 132 in the seal member 130 to make a tight seal with the outside surface of the seal member 130. The partition wall 121 extending from substantially the center of the inside of the seal member cover 120 is shaped to form a similarly tight seal. As previously described above, this provides a uniformly tight compression seal in a radial direction around the entire circumference of each of the electric wires 50 to improve the seal there between. Further, any deformation of the seal member 130 from the insertion of the electric wires 150 into the electric through-holes 132 exerts almost no effect on the electric wire receiving through-hole 132 opposite to it due to the intervening partition wall 121. Accordingly, even if a large number of the electric wires 50 are successively inserted into the seal member 130 at the rubber plug, no difficulties are encountered in the insertion operation.

The foregoing illustrates some of the possibilities for practicing the invention. Many other embodiments are possible within the scope and spirit of the invention. For example, although the waterproof connector 100 illustrated herein is a male connector, it will be appreciated by those skilled in the art that the waterproof connector 100 could alternatively be a female connector. Additionally, the invention is not limited to use with the electric wires 50. The invention may alternatively be used with other components, such as pipes, etc. It is, therefore, intended that the foregoing description be regarded as illustrative rather than limiting, and that the scope of the invention is given by the appended claims together with their full range of equivalents.

What is claimed is:

1. A waterproof connector, comprising:

a housing with a plurality of contact receiving cavities, each of the contact receiving cavities having a contact connected to an electric wire;

a seal member having a plurality of adjacent wire receiving through-holes through which the electric wires extend, the seal member having cylindrical areas around a circumference of each of the wire receiving through-holes, the cylindrical areas partially overlapping to form a continuous integral structure, the seal member being formed from an elastomer;

the seal member having a separating partition groove that partially extends through the seal member in a direction of insertion of the electric wires into the wire receiving through-holes, the separating partition groove partially separates the wire receiving through-holes into separate zones; and a partition wall that is received in the separating partition groove.

2. The waterproof connector of claim 1, wherein wire engaging gussets are formed on an outside surface of the seal member and engage an inner wall of the housing.

3. The waterproof connector of claim 1, wherein wire engaging gussets are formed on an inside surface of the wire receiving through-holes and engage the electric wires.

4. The waterproof connector of claim 1, wherein each of the zones has an equal amount of the wire receiving through-holes.

5. The waterproof connector of claim 1, wherein the wire receiving through-holes are arranged in a line.

6. The waterproof connector of claim 1, wherein the partition wall extends from a seal member cover attached to the housing.

7. The waterproof connector of claim 6, wherein the seal member cover and the seal member are integrally formed.

8. The waterproof connector of claim 6, wherein the seal member cover includes a plurality of cylindrical areas that partially overlap and are continuous with the wire receiving through-holes.

9. A seal member, comprising:

an elastomer with a plurality of adjacent wire receiving through-holes for receiving electric wires connected to contacts;

cylindrical areas around a circumference of each of the wire receiving through-holes, the cylindrical areas partially overlapping to form a continuous integral structure;

a separating partition groove that partially extends through the sealing member in a direction of insertion of the electric wires through the wire receiving through-holes, the separating partition groove partially separates the wire receiving through-holes into separate zones; and a partition wall that is received in the separating partition groove.

10. The seal member of claim 9, wherein wire engaging gussets are formed on an outside surface of the seal member for engaging an inside surface of a housing.

11. The seal member of claim 9, wherein wire engaging gussets are formed on an inside surface of the wire receiving through-holes for engaging the electric wires.

12. The seal member of claim 9, wherein each of the zones has an equal amount of the wire receiving through-holes.

13. The seal member of claim 9, wherein the wire receiving through-holes are arranged in a line.

14. The seal member of claim 9, wherein the partition wall extends from a seal member cover that engages the seal member.

15. The seal member of claim 14, wherein the seal member cover and the seal member are integrally formed.

16. The seal member of claim 14, wherein the seal member cover includes a plurality of cylindrical areas that partially overlap and are continuous with the wire receiving through-holes.

* * * * *